US007624583B2

(12) United States Patent
Yoshimi et al.

(10) Patent No.: US 7,624,583 B2
(45) Date of Patent: Dec. 1, 2009

(54) FREEZER DEVICE

(75) Inventors: Atsushi Yoshimi, Osaka (JP); Manabu Yoshimi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 683 days.

(21) Appl. No.: 10/566,726

(22) PCT Filed: Aug. 19, 2004

(86) PCT No.: PCT/JP2004/011895

§ 371 (c)(1),
(2), (4) Date: Feb. 2, 2006

(87) PCT Pub. No.: WO2005/017423

PCT Pub. Date: Feb. 24, 2005

(65) Prior Publication Data

US 2006/0185376 A1 Aug. 24, 2006

(30) Foreign Application Priority Data

Aug. 19, 2003 (JP) ..... 2003-295322

(51) Int. Cl.
*F25B 43/02* (2006.01)
*F25B 49/00* (2006.01)

(52) U.S. Cl. ..... 62/84; 62/192; 62/228.5; 62/470

(58) Field of Classification Search ..... 62/84, 62/192, 193, 468, 470, 471, 178, 180, 222, 62/224, 225, 226, 228.1, 228.5
See application file for complete search history.

(56) References Cited

U.S. PATENT DOCUMENTS 5,884,497 A * 3/1999 Kishita et al. ..... 62/193
6,185,955 B1 * 2/2001 Yamamoto ..... 62/470

FOREIGN PATENT DOCUMENTS

| | | | |
|---|---|---|---|
| JP | 61-110834 | A | 5/1986 |
| JP | 7-84971 | B2 | 9/1995 |
| JP | 63-73052 | A | 4/1998 |
| JP | 10-170108 | A | 6/1998 |
| JP | 2000-337717 | A | 12/2000 |
| JP | 2001-041613 | A | 2/2001 |

* cited by examiner

*Primary Examiner*—Marc E Norman
(74) *Attorney, Agent, or Firm*—Birch, Stewart, Kolasch, & Birch, LLP.

(57) ABSTRACT

A refrigeration system comprises a refrigerant circuit (10) in which a compressor (21), an outdoor heat exchanger (24) and an indoor heat exchanger (33) are connected to operate on a refrigeration cycle, and an oil recovery container (40) connected to the suction side of the compressor (21), and carries out a recovery operation for circulating refrigerant through the refrigerant circuit (10) to recover oil into the recovery container (40). The refrigeration system further comprises: a compressor control section (50) for stepwise increasing the operating capacity of the compressor (21) in an initial stage of the recovery operation so that the refrigerant temperature in the low pressure side of the refrigerant circuit (10) reaches or exceeds a predetermined value; and a fan control section (70) for continuously driving an indoor fan (33*a*) at least during a time period when the compressor (21) is driven. This suppresses an abrupt start-up of the compressor (21) and ensures that refrigerant in the indoor heat exchanger (33) evaporates. Thus, a temperature drop of refrigerant in the low pressure side can be prevented.

3 Claims, 4 Drawing Sheets

FREEZER DEVICE

TECHNICAL FIELD

This invention relates to refrigeration systems and particularly relates to measures for improving their pipe cleaning performance.

BACKGROUND ART

CFC (Chlorofluorocarbon)-based refrigerants or HCFC (Hydrochlorofluorocarbon)-based refrigerants have conventionally been used for refrigeration systems with a refrigerant circuit through which refrigerant circulates to operate on a vapor compression refrigeration cycle, such as air conditioning systems. The CFC-based and HCFC-based refrigerants, however, cause environmental problems, such as ozone layer depletion. It is therefore desired to renew such existing refrigeration systems into newer refrigeration systems using HFC (Hydrofluorocarbon)-based refrigerants or HC (Hydrocarbon)-based refrigerants.

Refrigerant pipes for connecting between a heat source unit and a heat use unit are often buried in structures such as buildings. Therefore, in such cases, it is difficult to change refrigerant pipes in renewing a refrigeration system. In these cases, to reduce the installation work period and cost, a new refrigeration system is installed by using the existing refrigerant pipes as they are.

Foreign materials, such as refrigeration oil for refrigeration systems using CFC-based or HCFC-based refrigerant containing chlorine, remain in the existing refrigerant pipes. Naphthenic mineral oil is mainly used as conventional refrigeration oil. If the naphthenic mineral oil is left and deteriorated in the refrigerant pipes, the expansion valves and other elements in the pipes may be corroded by chlorine ions or acids contained in the deteriorated mineral oil.

Therefore, before a new refrigeration system is installed and undergoes a trial run, it is necessary to clean the existing refrigerant pipes to remove residual foreign materials such as refrigeration oil.

A refrigeration system including a refrigerant circuit capable of a cleaning operation for the existing refrigerant pipes is disclosed, for example, in Japanese Unexamined Patent Publication No. 2001-41613. The refrigeration system includes a refrigerant circuit formed by connecting a heat source unit mainly including a compressor and a heat source side heat exchanger to an indoor unit having a heat use side heat exchanger via existing connecting pipes. A pipe on the suction side of the compressor is provided with oil recovery equipment for separating foreign materials such as refrigeration oil from refrigerant and recovering them.

After filled with HFC-based refrigerant, the refrigeration system activates the compressor to operate in cooling mode or heating mode so that the existing connecting pipes are cleaned by refrigerant circulating through the refrigerant circuit to collect foreign materials, such as refrigeration oil, into the oil recovery equipment.

Problems to Be Solved

In the refrigeration system of the above-described Patent Document 1, however, simply driving the compressor to circulate refrigerant through the refrigerant circuit leads to an abrupt rise (increase) in the frequency of the compressor after the activation. This may excessively decrease the temperature of refrigerant in the low pressure side of the circuit, resulting in a so-called overshoot of the refrigerant temperature. The overshoot of the refrigerant temperature decreases the temperature of residual refrigeration oil in the gas pipe to increase the viscosity thereof, which makes it difficult to remove the refrigeration oil through refrigerant circulation. This causes a problem that the effect of cleaning the pipes is reduced.

The present invention has been made in view. of the foregoing points and, therefore, its object is to prevent an abrupt temperature drop in the low-pressure pipe of the refrigerant circuit to prevent the viscosity of the refrigeration oil from increasing and thereby improve the effect of cleaning the pipes.

DISCLOSURE OF THE INVENTION

A first aspect of the invention is directed to a refrigeration system including: a refrigerant circuit (10) in which a compressor (21), a heat source side heat exchanger (24), an expansion mechanism (32) and a heat use side heat exchanger (33) are connected via refrigerant pipes to operate on a vapor compression refrigeration cycle; and an oil recovery container (40) connected to the suction side of the compressor (21), the refrigeration system carrying out a recovery operation for circulating refrigerant through the refrigerant circuit (10) via the recovery container (40) to recover oil into the recovery container (40). The refrigeration system further comprises a compressor control section (50) for stepwise increasing the operating capacity of the compressor (21) up to a predetermined capacity in an initial stage of the recovery operation so that the refrigerant temperature in the low pressure side of the refrigerant circuit (10) reaches or exceeds a predetermined value. The refrigeration system still further comprises a fan control section (70) for continuously driving a heat use side fan (33*a*) for the heat use side heat exchanger (33) in the recovery operation at least during driving of the compressor (21).

In the above aspect of the invention, when the compressor (21) is driven, refrigerant circulates through the refrigerant circuit (10) to provide a vapor compression refrigeration cycle. Through the refrigerant circulation, oil in the refrigerant pipes is carried away and recovered to flow into the recovery container (40), thereby cleaning the refrigerant pipes.

In this time, the compressor (21) is controlled by the compressor control section (50) to stepwise increase its operating capacity (frequency) up to a predetermined capacity during an initial stage of the recovery operation so that the refrigerant temperature in the low pressure side of the refrigerant circuit (10) reaches or exceeds a predetermined value. This prevents an abrupt start-up of the compressor (21) and, therefore, prevents an abrupt temperature drop of refrigerant in the suction side of the compressor (21) caused owing to an abrupt suction of the compressor (21), i.e., a so-called overshoot of the refrigerant temperature. The prevention of a refrigerant temperature drop prevents residual oil in the low pressure side of the refrigerant circuit (10) from decreasing its temperature and thereby prevents the oil from increasing its viscosity. As a result, oil in the pipes can be easily carried away through refrigerant circulation. In other words, the above-mentioned predetermined value of the refrigerant temperature is kept at a temperature at which oil has a viscosity that allows itself to be easily carried away.

Further, the heat use side fan (33*a*) is controlled by the fan control section (70) to continuously drive at least during driving of the compressor (21), i.e., at least while refrigerant circulates through the refrigerant circuit (10) via the heat use side heat exchanger (33). Thus, air is continuously taken to the heat use side heat exchanger (33) all through the recovery operation. Therefore, refrigerant surely exchanges heat with air to evaporate in the heat use side heat exchanger (33) all through the recovery operation. As a result, refrigerant in the low pressure side of the refrigerant circuit (10) can be further prevented from decreasing its temperature.

In a second aspect of the invention, the expansion mechanism (32) in the first aspect comprises an expansion valve (32). Further, the refrigeration system further comprises a valve control section (60) for stepwise increasing the opening of the expansion valve (32) up to a predetermined opening according to stepwise increase in the operating capacity of the compressor (21) in the initial stage of the recovery operation.

In the above aspect of the invention, the opening of the expansion valve (32) is stepwise increased by the valve control section (60) according to the increase in the amount of refrigerant sucked into the compressor (21). This ensures that refrigerant evaporates in the heat use side heat exchanger (33), which surely prevents a temperature drop of refrigerant in the low pressure side of the refrigerant circuit (10).

In a third aspect of the invention, the fan control section (70) in the first or second aspect drives the heat use side fan (33*a*) with a maximum airflow.

In the above aspect of the invention, refrigerant can be surely evaporated in the heat use side heat exchanger (33). This ensures that refrigerant in the low pressure side of the refrigerant circuit (10) is prevented from decreasing its temperature.

Effects

According to the first aspect of the invention, since the compressor control section (50) is provided to stepwise increase the operating capacity (frequency) of the compressor (21) up to a predetermined capacity during an initial stage of each recovery operation so that the refrigerant temperature in the low pressure side of the refrigerant circuit (10) can reach or exceed a predetermined value, this prevents an overshoot of the refrigerant temperature in the low pressure side, which is caused by an abrupt start-up of the compressor (21). Thus, residual refrigeration oil in the low pressure side of the refrigerant circuit (10) can be prevented from decreasing its temperature, thereby preventing viscosity increase of the refrigeration oil. As a result, the refrigeration oil can be easily removed and carried away through refrigerant circulation, which improves the pipe cleaning performance.

Further, since the fan control section (70) is provided to continuously drive the heat use side fan (33*a*) at least during driving of the compressor (21), i.e., at least while refrigerant circulates through the refrigerant circuit (10) via the heat use side heat exchanger (33), this enables refrigerant to exchange heat with air to evaporate in the heat use side heat exchanger (33) all through the recovery operation. As a result, refrigerant in the low pressure side of the refrigerant circuit (10) can be surely prevented from decreasing its temperature.

Further, since, according to the second aspect of the invention, the valve control section (60) is provided to stepwise increase the opening of the expansion valve (32) according to the increase in the operating capacity (frequency) of the compressor (21), i.e., according to the increase in the amount of refrigerant sucked into the compressor (21), this ensures that refrigerant evaporates in the heat use side heat exchanger (33). Therefore, refrigerant in the low pressure side of the refrigerant circuit (10) can be surely prevented from decreasing its temperature.

Further, since, according to the third aspect of the invention, the heat use side fan (33*a*) is driven with a maximum airflow under the control of the fan control section (70), this ensures that refrigerant evaporates in the heat use side heat exchanger (33).

BEST MODE FOR CARRYING OUT THE INVENTION

Embodiments of the present invention will be described below in detail with reference to the drawings.

Embodiment of the Invention

Figure 1:
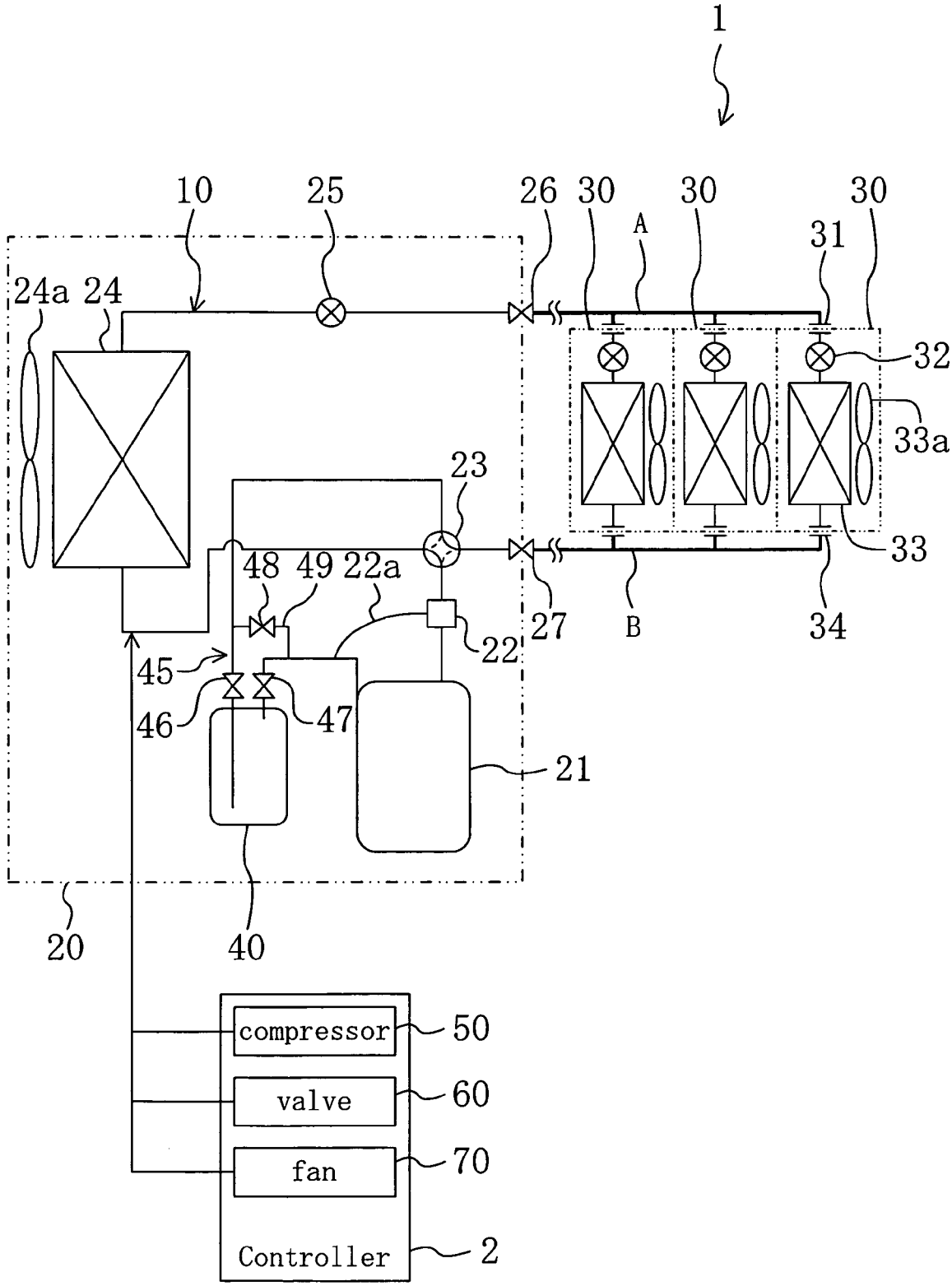
FIG. 1 is a refrigerant circuit diagram of an air conditioning system according to an embodiment of the invention.

As shown in FIG. 1, the refrigeration system of this embodiment is an air conditioning system (1) including a refrigerant circuit (10) which circulates refrigerant therethrough to operate on a vapor compression refrigeration cycle. The air conditioning system (1) selectively performs cooling and heating of the room.

The refrigerant circuit (10) is formed so that an outdoor unit (20) serving as a heat source unit is connected to a plurality of (three in this embodiment) indoor units (30) serving as heat use units by a liquid pipe (A) and a gas pipe (B) both of which are existing pipes. The outdoor unit (20) and the indoor units (30) are renewed for HFC-based refrigerant.

The three indoor units (30) are connected in parallel and with refrigerant pipes, respectively, branched from the liquid pipe (A) and refrigerant pipes, respectively, branched from the gas pipe (B). Each indoor unit (30) is formed so that an indoor expansion valve (32) serving as an expansion valve of the invention is connected via pipes to an indoor heat exchanger (33) serving as a heat use side heat exchanger of the invention. An electronic expansion valve is used as the indoor expansion valve (32). An indoor fan (33*a*) serving as a heat use side fan is disposed in proximity to each indoor heat exchanger (33).

The outdoor unit (20) is formed so that a compressor (21), an oil separator (22), a four-way selector valve (23), an outdoor heat exchanger (24) serving as a heat source side heat exchanger, and an outdoor expansion valve (25) serving as an expansion valve of the invention are connected in this order via pipes. An outdoor fan (24*a*) serving as a heat source side fan is disposed in proximity to the outdoor heat exchanger (24).

A first stop valve (26) serving as a flow path opening/closing means is disposed at the distal end of a pipe of the outdoor unit (20) located toward the outdoor expansion valve (25) so that the outdoor unit (20) is connected via the first stop valve (26) to one end of the liquid pipe (A). On the other hand, a second stop valve (27) serving as a flow path opening/ closing means is disposed at the distal end of a pipe of the outdoor unit (20) located toward the four-way selector valve (23) so that the outdoor unit (20) is connected via the second stop valve (27) to one end of the gas pipe (B).

The distal ends of pipes of the indoor units (30) located toward the indoor expansion valves (32) are connected via pipe joints (31), such as flared type pipe joints, to other ends of the liquid pipe (A). On the other hand, the distal ends of pipes of the indoor units (30) located toward the indoor heat exchangers (33) are connected via pipe joints (31), such as flared type pipe joints, to other ends of the gas pipe (B).

The refrigerant circuit (10) is configured to change the operation between cooling mode and heating mode by changing the position of the four-way selector valve (23). Specifically, when the four-way selector valve (23) changes to the position shown by the solid lines in FIG. 1, refrigerant circulates through the refrigerant circuit (10) operating in cooling mode in which refrigerant condenses in the outdoor heat exchanger (24). When the four-way selector valve (23) changes to the position shown by the broken lines in FIG. 1, refrigerant circulates through the refrigerant circuit (10) operating in heating mode in which refrigerant evaporates in the outdoor heat exchanger (24).

For example, during operation in cooling mode, refrigerant compressed by the compressor (21) is allowed for oil to be separated and removed from itself in the oil separator (22), condenses in the outdoor heat exchanger (24), passes through the outdoor expansion valve (25), expands in each indoor expansion valve (32), evaporates in each indoor heat exchanger (33) and returns to the compressor (21). The refrigerant repeats this circulation.

The refrigerant circuit (10) has a recovery container (40) for recovering oil into the outdoor unit (20). The recovery container (40) is connected via an inflow pipe (42) and an outflow pipe (43) to a refrigerant pipe running between the suction side of the compressor (21) and the four-way selector valve (23). The inflow pipe (42) and the outflow pipe (43) are provided with an inflow valve (46) and an outflow valve (47), respectively, which are on-off valves.

Figure 2:
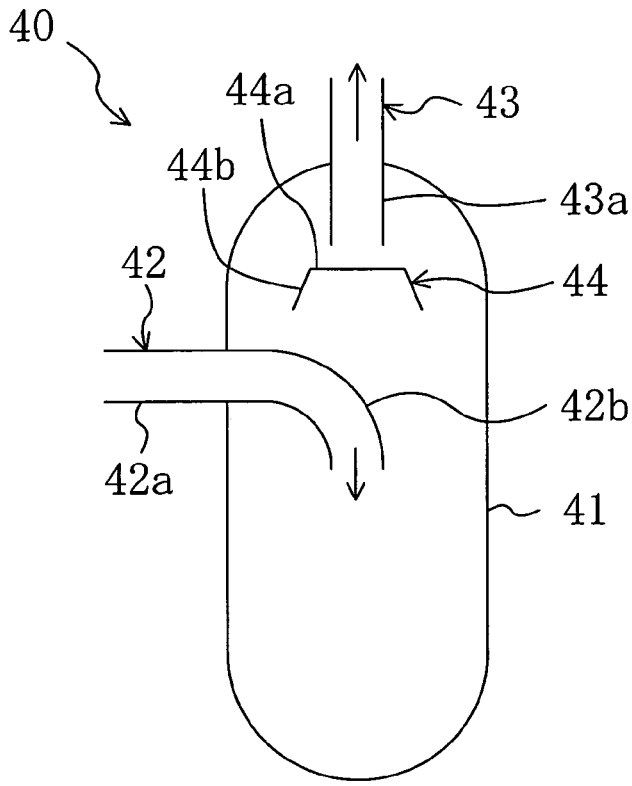
FIG. 2 is a cross-sectional view showing a schematic structure of a recovery container according to the embodiment.

As shown in FIG. 2, the recovery container (40) has a closed dome-shaped casing (41). The inflow pipe (42) is connected to the casing (41) at the side surface, while the outflow pipe (43) is connected to the top of the casing (41).

The inflow pipe (42) has a straight part (42*a*) which extends horizontally to pass through the side wall of the casing (41). Further, a downwardly bent part (42*b*) is formed to continue to the inner end of the straight part (42*a*) and the lower end of the bent part (42*b*) serves as an outlet end. On the other hand, the outflow pipe (43) has a straight part (43*a*) which extends vertically to pass through the upper wall of the casing (41) and the lower end of the straight part (43*a*) serves as an inlet end. Further, the inlet end of the outflow pipe (43) is located in the recovery container (40) above the outlet end of the inflow pipe (42).

An inverted dish-shaped baffle (44) is placed in the recovery container (40). The baffle (44) is composed of a flat horizontal plate (44*a*) and tilting plates (44*b*) extending downwardly from respective edges of the horizontal plate (44*a*) to tilt outwardly. The baffle (44) is disposed to face the lower end of the outflow pipe (43) with a predetermined space left therebetween in order to prevent oil separated in the recovery container (40) from splashing up and flowing out through the outflow pipe (23).

The refrigerant circuit (10) is provided with a bypass pipe (49) which is a pipe for bypassing the recovery container (40). The bypass pipe (49) forms part of the refrigerant pipe running between the suction side of the compressor (21) and the four-way selector valve (23) and is connected to the joint for the inflow pipe (42) and the joint for the outflow pipe (43). The bypass pipe (49) is provided with a bypass valve (48) which is an on-off valve. The inflow valve (46), the outflow valve (47) and the bypass valve (48) constitute a selector (45).

In cooling mode operation for pipe cleaning, the refrigerant circuit (10) is configured to shift the selector (45), i.e., open the inflow valve (46) and the outflow valve (47) while closing the bypass valve (48), thereby allowing refrigerant to circulate by flowing through the inflow pipe (42), the recovery container (40) and the outflow pipe (43) to. In other words, the refrigerant circuit (10) is configured to carry out a recovery operation for recovering oil into the recovery container (40) through refrigerant circulation in which refrigerant flows through the recovery container (40). Then, in a normal operation after the pipe cleaning, the refrigerant circuit (10) is configured to shift the selector (45), i.e., close the inflow valve (46) and the outflow valve (47) while opening the bypass valve (48), thereby allowing refrigerant to circulate by bypassing the recovery container (40) and flowing through the bypass pipe (49).

The oil separator (22) is provided with an oil return pipe (22*a*). The oil return pipe (22*a*) is connected at one end to the oil separator (22) and connected at the other end to the suction side of the compressor (21) and downstream of the joint for the outflow pipe (43) of the recovery container (40). The oil return pipe (22*a*) is configured so that refrigeration oil for HFC-based refrigerant separated and removed in the oil separator (22) flows through itself from the oil separator (22) to the suction side of the compressor (21).

In the recovery operation, the refrigerant circuit (10) is controlled by a controller (2). The controller (2) includes a compressor control section (50), a valve control section (60) and a fan control section (70).

The compressor control section (50) is configured to stepwise increase the operating capacity of the compressor (21) up to a predetermined capacity in an initial stage of each recovery operation so that the refrigerant temperature in the lower side of the refrigerant circuit (10) can reach or exceed a predetermined value. In other words, the compressor control section (50) is configured to prevent an abrupt temperature drop of refrigerant in the suction side of the compressor (21) from occurring owing to an abrupt suction of the compressor (21) just after activated, i.e., prevent a so-called overshoot of the refrigerant temperature. Specifically, when the compressor (21) is activated, its operating frequency is increased at a lower rate of acceleration than normal and then held at a predetermined constant frequency for the normal operation after a predetermined time has passed from the activation.

The valve control section (60) is configured to stepwise increase the opening of each indoor expansion valve (32) up to a predetermined opening according to the stepwise increase in the operating capacity of the compressor (21) in the initial stage of each recovery operation. In other words, the valve control section (60) is configured to control the opening of each indoor expansion valve (32) according to the amount of refrigerant sucked by the compressor (21) to allow the superheated refrigerant to flow through the low pressure side of the refrigerant circuit (10).

The fan control section (70) is configured to drive the indoor fan (33*a*) for each indoor heat exchanger (33) before the activation of the compressor (21) for each recovery operation and then continuously run the indoor fan (33*a*) also during driving of the compressor (21). In other words, the fan control section (70) is configured to drive the indoor fan (33*a*) for each indoor heat exchanger (33) concurrently with or prior to the activation of the compressor (21) in each recovery operation. In still other words, each indoor fan (33*a*) is run continuously at least during the flow of refrigerant through the corresponding indoor heat exchanger (33) in each recovery operation.

A first embodiment of the present invention will be described below.

—Operation Behavior—

Next, a method for changing the indoor and outdoor units (20, 30) will be first described and the recovery operation of the air conditioning system (1) will be then described.

<Method for Changing Indoor and Outdoor Units>

A description will be made of a method for changing, in renewal of the existing air conditioning system (1) using CFC-based refrigerant or HCFC-based refrigerant, the existing outdoor unit (20) and indoor units (30) to new outdoor unit (20) and indoor units (30) for HFC-based refrigerant while using the existing liquid pipe (A) and gas pipe (B) as they are.

First, previous CFC-based or HCFC-based refrigerant is recovered from the existing air conditioning system (1). Then, the existing liquid pipe (A) and gas pipe (B) are left as they are and the existing outdoor unit (20) and indoor units (30) are removed at the pipe joints (31, 34), such as flared type pipe joints, and stop valves (26, 27) from the liquid pipe (A) and gas pipe (B). Thereafter, new outdoor unit (20) and indoor units (30) are installed and connected via the pipe joints (31, 34) and stop valves (26, 27) to the existing liquid pipe (A) and gas pipe (B), thereby forming the refrigerant circuit (10).

Next, since the new outdoor unit (20) is previously filled with HFC-based refrigerant as a new refrigerant, the indoor unit (30), the liquid pipe (A) and the gas pipe (B) are evacuated with the first stop valve (26) and second stop valve (27) closed to remove air and water from inside the refrigerant circuit (10) except for the outdoor unit (20). Then, the first stop valve (26) and second stop valve (27) are opened and the refrigerant circuit (10) is additionally filled with HFC-based refrigerant.

<Recovery Operation>

Next, a description will be made of a recovery operation for removing residual refrigeration oil for previous refrigerant in the air conditioning system (1), particularly in the existing liquid pipe (A) and gas pipe (B) and recovering it into the recovery container (40). This recovery operation is an operation carried out in the cooling mode of the air conditioning system (1) (when the four-way selector valve (23) is in a position shown in the solid lines in FIG. 1).

First, when the compressor (21) of the refrigerant circuit (10) is deactivated, the inflow valve (46) and outflow valve (47) are opened and the bypass valve (48) is closed. Further, the outdoor expansion valve (25) is set to a full opening. In this state, the indoor fan (33*a*) of each indoor heat exchanger (33) is driven by a command from the fan control section (70).

When the compressor (21) is driven under the above condition of the refrigerant circuit (10), gas refrigerant compressed by the compressor (21) is discharged together with refrigeration oil for HFC-based refrigerant and flows into the oil separator (22). The refrigeration oil for HFC-based refrigerant is separated in the oil separator (22) and the gas refrigerant only flows through the four-way selector valve (23) into the outdoor heat exchanger (24). In the outdoor heat exchanger (24), the gas refrigerant exchanges heat with outside air taken in by the outdoor fan (24*a*) to condensate into liquid form.

The condensed liquid refrigerant flows through the outdoor expansion valve (25), the first stop valve (26) and the liquid pipe (A) and then flows into each indoor expansion valve (32) to reduce its pressure. The reduced liquid refrigerant then exchanges heat with room air taken to the indoor heat exchanger (33) by the indoor fan (33*a*) to evaporate into gas form. The gas refrigerant produced by evaporation flows through the as pipe (B), the second stop valve (27) and the four-way selector valve (23) into the recovery container (40).

The above refrigerant circulation allows carry-away of residual refrigeration oil for previous refrigerant in the refrigerant pipes, particularly in the liquid pipe (A) and gas pipe (B) and inflow into the recovery container (40) with refrigerant. In this manner, the refrigerant pipes can be cleaned.

The gas refrigerant flowing into the recovery container (40) flows through the inflow pipe (42) and is discharged to inside the casing (41) toward its bottom. Since the flow rate of refrigerant when discharged is lower than when circulating through the refrigerant circuit (10), oil is separated from the gas refrigerant and stored in the recovery container (40). Then, only the gas refrigerant flows through the outflow pipe (43), returns to the refrigerant circuit (10) and is sucked again into the compressor (21). The refrigerant circuit (10) repeats such refrigerant circulation. Thus, oil in the refrigerant pipes can be recovered in the recovery container (40). For example, even if already stored oil flashes up to the vicinity of the inlet end of the outflow pipe (43) when the gas refrigerant is discharged from the inflow pipe (42) toward the bottom of the recovery container (40), the baffle (44) acts an obstacle so that the oil can be prevented from flowing out through the outflow pipe (43). This ensures that oil in the refrigerant pipes is recovered into the recovery container (40).

After the end of the recovery operation, the inflow valve (46) and outflow valve (47) are closed while the bypass valve (48) is opened. Thus, the normal operation can be carried out so that refrigerant circulates through the refrigerant circuit (10) without flowing through the recovery container (40).

<Controls of Various Control Sections>

Next, a description will be made of controls of the compressor control section (50), the valve control section (60) and the fan control section (70).

Figure 3:
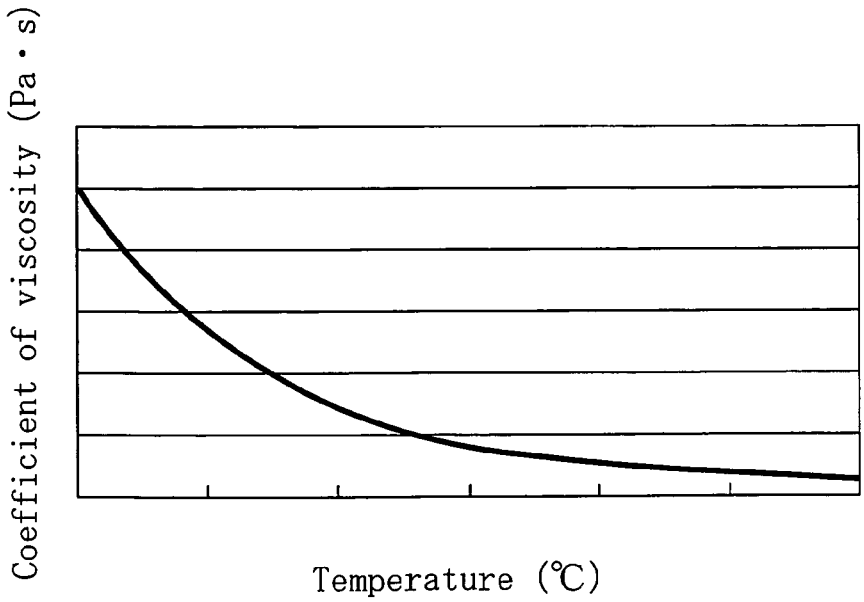
FIG. 3 is a graph showing the relation between the temperature and the coefficient of viscosity of refrigeration oil.

When the compressor (21) is activated, the compressor (21) normally raises its operating frequency with a maximum rate. Therefore, in that case, refrigerant is abruptly discharged into the high-pressure side pipe of the refrigerant circuit (10) and, concurrently, refrigerant in the low-pressure side pipe of the refrigerant circuit (10) is abruptly sucked into the compressor (21). Such an abrupt suction of the compressor (21) abruptly decreases the pressure of refrigerant in the low pressure side of the refrigerant circuit (10), leading to an abrupt temperature drop of the refrigerant (an overshoot of the refrigerant temperature). The overshoot of the refrigerant temperature decreases the temperature of residual refrigeration oil in the low pressure side of the refrigerant circuit (10) to increase the viscosity of the refrigeration oil (see FIG. 3). Therefore, it becomes difficult in this case to remove refrigeration oil through refrigerant circulation.

Figure 4:
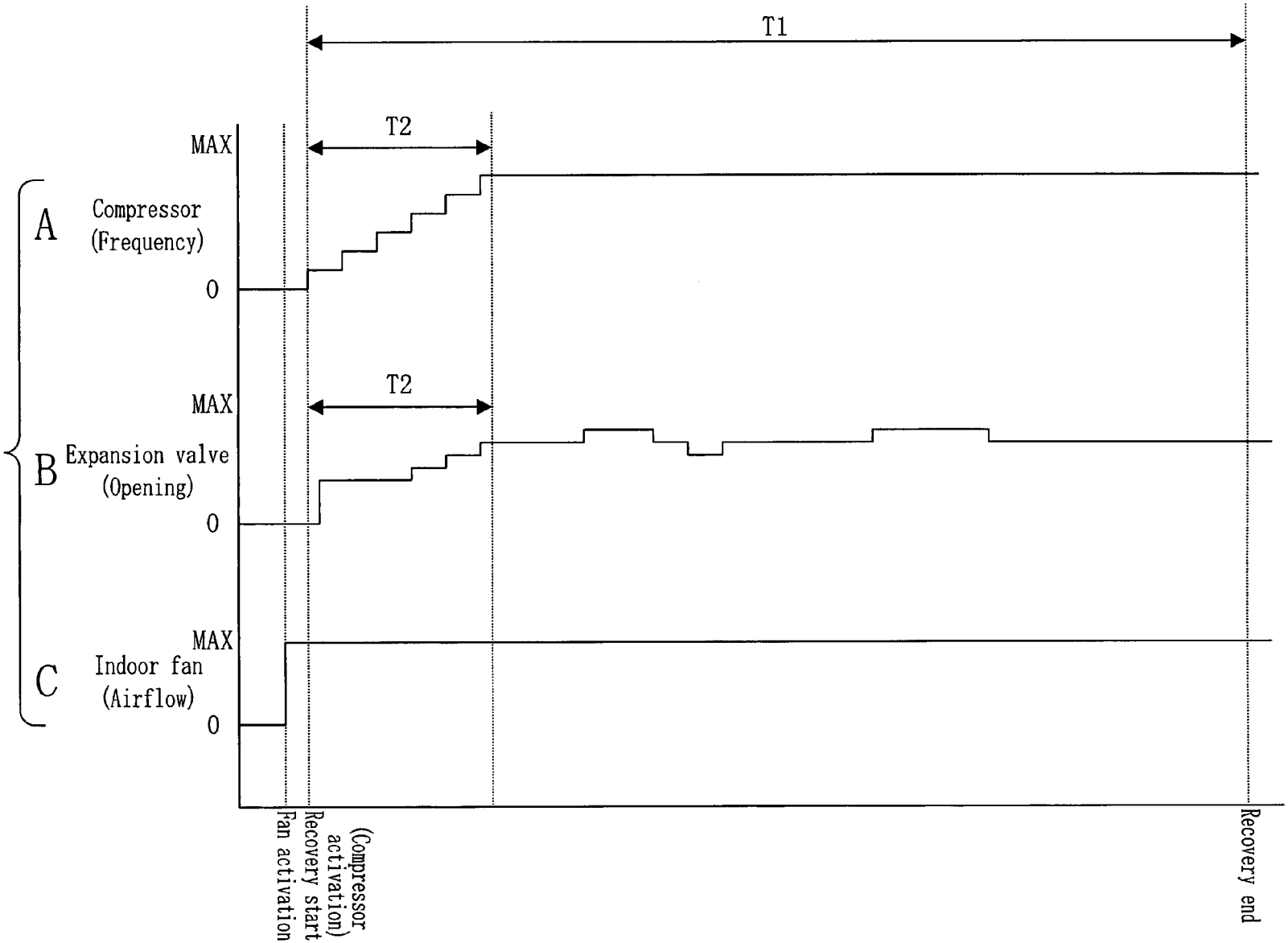
FIG. 4 is a diagram showing time charts for various control sections according to the embodiment, wherein (A), (B) and (C) show controls over the compressor, the indoor expansion valve and the indoor fan, respectively.

In this relation, the compressor (21) is controlled by a command from the compressor control section (50) to run so that the refrigerant temperature in the low pressure side of the refrigerant circuit (10) can reach or exceed a predetermined value, i.e., so that the overshoot of the refrigerant temperature can be prevented. Specifically, as shown in FIG. 4A, the compressor (21) stepwise increases its frequency for a predetermined time period (T2) from its activation, i.e., for an initial stage of each recovery operation time period (T1), and then continuously runs with a constant frequency until the end of the recovery operation. This prevents an abrupt start-up of the compressor (21), which prevents an overshoot of the refrigerant temperature. Therefore, residual refrigeration oil in the low pressure side of the refrigerant circuit (10) can be prevented from decreasing its temperature, thereby preventing viscosity increase of the refrigeration oil. As a result, it becomes possible to easily remove and carry away oil in the pipes through refrigerant circulation. In this case, the recovery operation time period (T1) is a time period from the activation of the compressor (21) to the deactivation thereof.

Each indoor expansion valve (32) is controlled by a command from the valve control section (60) to change its opening according to the stepwise increase of the frequency of the compressor (21). Specifically, as shown in FIG. 4B, the opening control on each indoor expansion valve (32) is carried out by stepwise increasing the opening during the predetermined time period (T2) from the activation of the compressor (21), i.e., during a time period when the frequency of the compressor (21) stepwise increases, and then controlling the opening until the end of the recovery operation so that the refrigerant can have a constant degree of superheat as during the normal operation.

In other words, the opening of each indoor expansion valve (32) increases according to the amount of refrigerant sucked into the compressor (21) and, in each indoor heat exchanger (33), refrigerant is surely held at a predetermined degree of superheat. This prevents a temperature drop of refrigerant in the low pressure side of the refrigerant circuit (10).

As shown in FIG. 4C, based on a command from the fan control section (70), each indoor fan (33*a*) is driven from before the start of each recovery operation, i.e., from before the activation of the compressor (21), and continuously driven with a maximum airflow (MAX) until the end of the recovery operation. In this case, at least while refrigerant flows through each indoor heat exchanger (33), the indoor fan (33*a*) continuously takes room air to the indoor heat exchanger (33) and, therefore, refrigerant surely exchanges heat with room air to evaporate. Therefore, refrigerant in the low pressure side of the refrigerant circuit (10) can be prevented from decreasing its pressure and temperature during the recovery operation.

Figure 5:
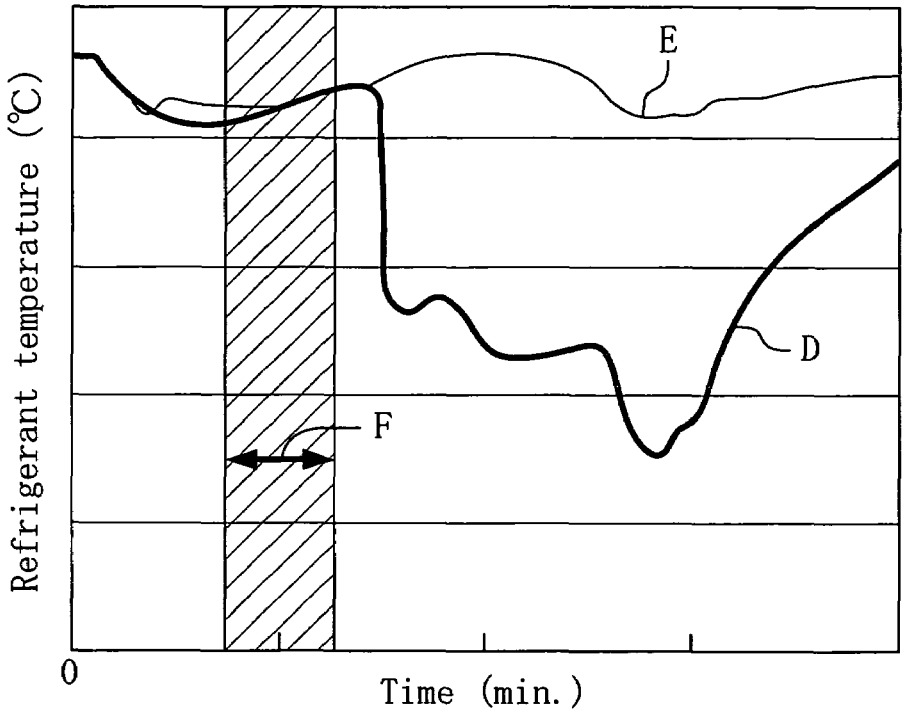
FIG. 5 is a graph showing the relation between the operating condition of the indoor fan and refrigerant temperature.
Figure 6:
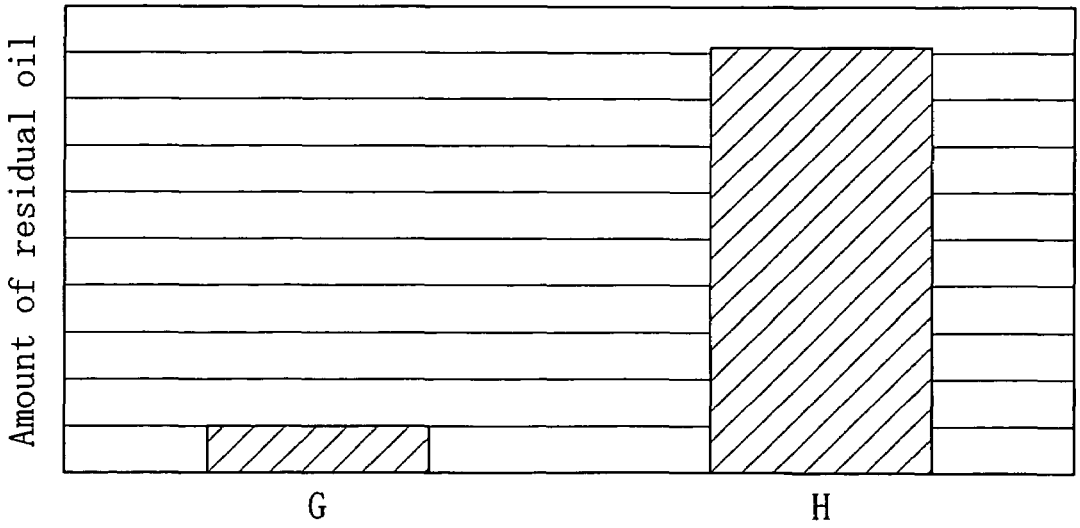
FIG. 6 is a graph showing the relation between the operating condition of the indoor fan and the amount of residual oil in the pipes after cleaned.

In this relation, as shown in FIG. 5, a comparison of the refrigerant temperature in the low-pressure side gas pipe of the refrigerant circuit (10) is made between the case where a halt interval (F) is set during the driving of the indoor fan (33*a*) (the bold line D) and the case where the indoor fan (33*a*) is continuously driven across the predetermined time period (the thin line E). The comparison shows that, in the former case, the refrigerant temperature in the low-pressure side gas pipe of the refrigerant circuit (10) abruptly drops. Further, as shown in FIG. 6, a comparison of the amount of residual oil in the low-pressure side gas pipe of the refrigerant circuit (10) after recovery operation is made between the case (G) where the indoor fan (33*a*) is continuously driven across the predetermined time period and the case (H) where a halt interval (F) is set during the driving of the indoor fan (33*a*). The comparison shows that the amount of residual oil in the case G is extremely small as compared with the case H. It can be seen also from these points that if each indoor fan (33*a*) is continuously driven during each recovery operation, this prevents a decrease in the refrigerant temperature in the low pressure side of the refrigerant circuit (10). Further, it can be seen that the prevention of a decrease in refrigerant temperature allows easy removal of oil in the pipes through refrigerant circulation.

Effects of Embodiment

As described so far, since in this embodiment the compressor control section (50) is provided to stepwise increase the frequency of the compressor (21) during an initial stage of each recovery operation, an abrupt drop in the refrigerant temperature, i.e., a so-called overshoot of the refrigerant temperature, in the low pressure side of the refrigerant circuit (10) can be prevented. This prevents a temperature drop of residual refrigeration oil in the low pressure side of the refrigerant circuit (10) and, therefore, prevents a viscosity increase of the refrigeration oil. As a result, the refrigeration oil can be easily removed and carried away through refrigerant circulation, which improves the pipe cleaning performance.

Further, since the valve control section (60) is provided to stepwise increase the opening of each indoor expansion valve (32) according to the increase in the frequency of the compressor (21), i.e., the amount of refrigerant sucked into the compressor (21), the refrigerant in each indoor heat exchanger (33) can be held at a predetermined degree of superheat. This surely prevents the refrigerant temperature in the low pressure side of the refrigerant circuit (10) from decreasing.

Further, since the fan control section (70) is provided to continuously drive each indoor fan (33*a*) from prior to each recovery operation, i.e., from prior to the activation of the compressor (21), to the end of the recovery operation, this ensures that at least while refrigerant flows through each indoor heat exchanger (33), refrigerant in each indoor heat exchanger (33) surely exchanges heat with room air to evaporate. Thus, the refrigerant temperature in the low pressure side of the refrigerant circuit (10) can be prevented from decreasing.

Furthermore, since each indoor fan (33*a*) is driven with a maximum airflow under the control of the fan control section (70), refrigerant in each indoor heat exchanger (33) can be surely evaporated.

Other Embodiments

In the present invention, the above embodiment may have the following configurations.

The above embodiment is configured to circulate refrigerant through the refrigerant circuit (10) so that it can flow through all (three) indoor heat exchangers (33). For example, refrigerant may be circulated through the refrigerant circuit (10) so that it can flow through only one arbitrarily selected from the three indoor heat exchangers (33) and then sequentially flow through the remaining two indoor heat exchangers (33) in this manner. Specifically, this refrigerant circulation is carried out by fully closing the indoor expansion valves (32) for the remaining two indoor heat exchangers (33) except for the arbitrarily selected one.

Further, the above embodiment describes the case of using three indoor units (30). Needless to say, a single or a plurality of indoor units may be used.

Furthermore, it is a matter of course that the present invention can be applied to, in addition to air conditioning systems, various kinds of refrigeration systems.

INDUSTRIAL APPLICABILITY

As seen from the above description, the present invention is useful as a refrigeration system capable of cleaning the refrigerant pipes.

The invention claimed is:

1. A refrigeration system including: a refrigerant circuit (10) in which a compressor (21), a heat source side heat exchanger (24), an expansion mechanism (32) and a heat use side heat exchanger (33) are connected via refrigerant pipes to operate on a vapor compression refrigeration cycle; and an oil recovery container (40) connected to the suction side of the compressor (21), the refrigeration system carrying out a recovery operation for circulating refrigerant through the refrigerant circuit (10) via the recovery container (40) and carrying out a normal operation while storing the recovered oil in the recovery container (40) after the recovery operation, wherein the refrigeration system further comprises:

a compressor control section (50) for stepwise increasing the operating capacity of the compressor (21) up to a predetermined capacity in an initial stage of the recovery operation so that an abrupt drop of the refrigerant temperature in the low pressure side of the refrigerant circuit (10) is suppressed; and a fan control section (70) for continuously driving a heat use side fan (33*a*) for the heat use side heat exchanger (33) in the recovery operation at least during driving of the compressor (21).

2. The refrigeration system of claim 1, wherein the expansion mechanism (32) comprises an expansion valve (32), and the refrigeration system further comprises a valve control section (60) for stepwise increasing the opening of the expansion valve (32) up to a predetermined opening according to stepwise increase in the operating capacity of the compressor (21) in the initial stage of the recovery operation.

3. The refrigeration system of claim 1 or 2, wherein the fan control section (70) drives the heat use side fan (33*a*) with a maximum airflow.

* * * * *

UNITED STATES PATENT AND TRADEMARK OFFICE

CERTIFICATE OF CORRECTION

PATENT NO. : 7,624,583 B2
APPLICATION NO. : 10/566726
DATED : December 1, 2009
INVENTOR(S) : Yoshimi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 974 days.

Signed and Sealed this

Twenty-sixth Day of October, 2010

David J. Kappos

David J. Kappos
*Director of the United States Patent and Trademark Office*